United States Patent [19]

Lin et al.

[11] Patent Number: 4,952,275

[45] Date of Patent: Aug. 28, 1990

[54] COPPER ETCHING SOLUTION AND METHOD

[75] Inventors: Charles W. C. Lin; Ian Y. K. Yee, both of Austin, Tex.

[73] Assignee: Microelectronics and Computer Technology Corporation, Austin, Tex.

[21] Appl. No.: 452,458

[22] Filed: Dec. 15, 1989

[51] Int. Cl.[5] ..... C23F 1/00; B44C 1/22; C09K 13/00; C03C 15/00

[52] U.S. Cl. ..... 156/666; 156/656; 156/659.1; 156/901; 252/79.1; 252/79.4

[58] Field of Search ..... 252/79.1, 79.2, 79.4; 156/634, 656, 659.1, 666, 901, 902; 134/2, 3

[56] References Cited

U.S. PATENT DOCUMENTS

| | | | |
|---|---|---|---|
| 2,978,301 | 4/1961 | Margulies et al. | 252/79.2 X |
| 2,982,625 | 5/1961 | Saubestre | 252/79.2 X |
| 3,231,503 | 1/1966 | Laue | 252/79.5 X |
| 3,466,208 | 9/1969 | Slominski | 196/18 |
| 3,514,408 | 5/1970 | Barth et al. | 252/79.1 |
| 3,717,521 | 9/1970 | Slomenski et al. | 156/18 |
| 4,311,551 | 1/1982 | Sykes | 156/640 |
| 4,319,955 | 2/1982 | Murski | 156/659.1 |
| 4,401,509 | 8/1983 | Schellinger, Jr. | 156/666 |
| 4,419,183 | 12/1983 | Gulla et al. | 156/666 |
| 4,437,931 | 3/1984 | Elias et al. | 156/666 |
| 4,459,216 | 7/1984 | Nakazato et al. | 252/79.4 |
| 4,462,861 | 7/1984 | McClean | 156/640 |
| 4,497,687 | 2/1985 | Nelson | 156/689.1 |
| 4,510,018 | 4/1985 | McGowan | 156/666 |
| 4,545,850 | 10/1985 | Nelson | 156/642 |
| 4,586,961 | 5/1986 | Bradley et al. | 134/2 |
| 4,604,144 | 8/1986 | Wong | 134/28 |
| 4,632,727 | 12/1986 | Nelson | 156/656 |
| 4,636,282 | 1/1987 | Wong | 156/659.1 |
| 4,810,332 | 3/1989 | Pan | 204/15 |

OTHER PUBLICATIONS

Mathers et al., "Stripping of Copper from Various Base Metals", A.E.S. Research Project Serial No. 1, American Electroplater's Society, 1945, pp. 1–12.

Mathers et al., "Stripping of Copper from Various Base Metals", A.E.S. Research Project Serial No. 7, American Electroplater's Society, 1945, pp. 1–15.

Novak et al., "An Ellipsometric Study of Surface Films on Copper Electrodes Undergoing Electropolishing", Journal of the Electrochemical Society, Jun. 1970, vol. 117, No. 6, pp. 733–737.

Glarum, "The Anodic Dissolution of Copper into Phosphoric Acid", Journal of the Electrochemical Society, Dec., 1985, vol. 132, No. 12, pp. 2872–2877.

Sweet et al., "Copper Etching Process for Fine Line PCBs", PC Fab, Aug., 1987, pp. 36–44.

Murray, "One-Way Etch", Circuits Manufacturing, Aug., 1987, pp. 23–25.

Nelson et al., "Focus on Fabricators–Psi Star", PC Fab, Apr., 1988, pp. 87–89.

Meek, "Transition Metal Ion Complexes of Dimethyl Sulfoxide", Journal of the Chemical Society, Dec., 1960, vol. 82, pp. 6013–6016.

Psi Star, "Ultra-Fine Lines and Spaces", 1987.

MacDermid Inc., "Metex Etchants MU," Technical Data Sheet No. 9114.

MacDermid, Inc., "Ultra-Bright", Technical Data Sheet No. 9226.

Nelson et al., "A System for Producing Circuit Boards with Fine Lines Having Controlled Geometrics", PS001.

Nelson et al., "The Nitric Acid Process for Etching Circuit Boards", PSI 002.

Nelson, "Comparison of Etching Chemistries", PSI 003.

Battey et al., "The Relationship Between the Crystal Structure and Anisotropy of Etching Electrodeposited Copper Foil", PSI 004.

Pourbaix, "Atlas of Electrochemical Equilibria in Aqueous Solutions", pp. 387–391.

*Primary Examiner*—William A. Powell

*Attorney, Agent, or Firm*—Fulbright & Jaworski

[57] ABSTRACT

A process and solution for selectively etching copper. The etching is effected by a nonaqueous solution of dimethyl sulfoxide and a halocarbon compound.

10 Claims, No Drawings

COPPER ETCHING SOLUTION AND METHOD

BACKGROUND OF THE INVENTION

This invention relates to a process and solution for etching copper and copper oxides, and, more particularly, for selectively etching copper and copper oxides during the preparation of high density, multilayer interconnects.

The fabrication of a high density, multilayer interconnect often requires three components. They are the substrate materials, the interlayer dielectric, and the electrical conductor. To ensure system integrity, these materials must be compatible with each other as well as with VLSI devices. Copper and polyimide are often selected as the preferred conductor and interlayer dielectric, respectively. Copper is selected due to its low electrical resistance, high thermal conductivity, availability, and low cost. Polyimide is the selected interlayer dielectric due to its low dielectric constant, high thermal and chemical stability, good planarization characteristics, and ease of processing. However, poor macroscopic adhesion at the copper-polyimide interface is generally reported and attributed to the weak interface formation and islanding of copper on polyimide. In addition, the migration of copper-rich precipitates into polyimide can potentially change the dielectric properties of the polyimide. Consequently, an adhesion/diffusion barrier layer is usually placed between the copper and polyimide for long term reliability purposes. A variety of metal-polyimide systems have been investigated, with particular focus on chromium, titanium, nickel, and aluminum. To prevent delamination between the copper and polyimide on the sidewalls of the conductor features, a protective nickel overcoat can be used to form a barrier layer. Nickel may be selected due to its excellent corrosion resistance, and ease of low cost electrolytic plating.

Such metallized electrical interconnect substrates are typically prepared by sputtering an adhesion layer and then plating the interconnect on a polyimide surface. The metallization can include, for instance, a layer of chromium adjacent the polyimide, a layer of copper as the electrolytic plating interconnect, and a layer of titanium over the copper as a protective film. Photoresist is then spin coated and exposed to define the pattern for conductor and pillar plating. After electrolytic plating and stripping the photoresist, a thin layer of nickel overcoat is applied over the copper features to prevent corrosion and delamination problems. The substrate is then brought in contact with titanium, copper, and chromium etching solutions separately to remove those portions of the sputtered interconnect layers lying beneath the unexposed photoresist. The remaining unetched metallization will then form the desired electrical conductive network. As an example of such a process, reference is made to assignee's U.S. Pat. No. 4,810,332. As indicated therein, etching is a preferred subtractive process for copper removal.

Because, however, the protective nickel overcoat has a thickness in the range of a few microns, problems tend to arise when different etchants are in contact with nickel during the stripping process. Metal etchants with low selectivity may potentially attack the thin nickel overcoat thereby leaving portions of the underlying copper conductor unprotected. Such uncontrollability of the etching process is obviously undesirable since it can jeopardize fabrication yields as well as degrade the performance of the interconnects. Therefore, there is a need for an etching process which can selectively etch metals such as titanium, copper, and chromium without cross-attacking disimilar metals.

Copper etching is a well-known process in the printed circuit/electrical interconnect industry. The early etchants were often acid-based. For example, ferric chloride, chrome/sulfuric acid, hydrogen peroxide/sulfuric acid, and ammonium persulfate were predominant electronic grade etchants. A variety of these etching solutions are described in U.S. Pat. Nos. 2,982,625; 2,978,301; 4,401,509; 4,419,183; 4,437,931; 4,459,216; 4,462,861; 4,510,018; and 4,636,282.

Because of waste disposal and other problems with the acid-based etchants, alkaline-based solutions became the etchants of choice thereafter for many applications. These etchants most often were aqueous ammoniacal solutions containing carbonate ions and an oxidizing agent, such as sodium chlorite. Etchants of this type are described in U.S. Pat. Nos. 3,231,503 and 3,466,208. Both patents disclose etching solutions with comprise sodium chlorite, ammonium hydroxide and an ammonium salt, such as ammonium bicarbonate.

Other examples can be found of acid-based and alkaline-based copper etchants incorporating a variety of modifiers which achieve desirous advantageous properties. For instance, U.S. Pat. No. 3,514,408 describes an etchant which includes a film modifier, such as phthalic anhydride or phthalimide. U.S. Pat. No. 4,311,551 describes an etchant which includes an etch accelerating additive, such as cyanamide. Finally, U.S. Pat. No. 4,319,955 describes the effects of 5-nitro 1H indazole or pyrazole in combination with cupric ions, ammonium salt, ammonium hydroxide, and water.

More recently, certain new etching chemistries which are based on nitric solutions have been developed by Psi Star. U.S. Pat. Nos. 4,497,687; 4,545,850; and 4,632,727 describe such solutions which can improve the anisotropicity of copper etching with a specific crystal structure.

Thus, the forementioned references reflect the numerous copper etchant solutions to date. However, in the fabrication of high density interconnects, the existing etching techniques suffer several drawbacks: they are not sufficiently selective of the materials that are etched, and they can cause unacceptable damage to a thin protective nickel overcoat. These etchants tend to either etch the nickel overcoat or create pits on the nickel overcoat which thereafter degrade the protective effects.

The present invention overcomes the above-mentioned drawbacks by using dimethyl sulfoxide and a halocarbon compound organic mixture, whereby copper can be selectively etched without affecting other metals such as nickel, chromium, and titanium. In addition, with the solution of the present invention, the etching rate can be precisely modulated by adjusting the ratio of these components based on the desired processing window. This allows for the effective selective removal of copper in a wide variety of commercially important processes in addition to the fabrication of high density interconnects.

SUMMARY OF THE INVENTION

It is, therefore, an object of the present invention, to provide an improved etchant solution which selectively etches copper but not nickel.

Another object of the invention is to provide a nonaqueous etching solution.

Yet another object of the present invention is to provide an etching solution which etches without undercutting.

Still another object of the invention is to provide an improved etching process for selectively etching copper.

Thus, in accordance with one aspect of the present invention, there is provided a nonaqueous copper etching solution, comprising dimethyl sulfoxide and a halocarbon compound. The halocarbon compound may be selected from a variety of such compounds, for example, mono- or multi- haloakylacetates, haloalkanes, haloalkenes, and halocarboxylic acids. More particularly, preferred halocarbons include di- or trihaloakylacetate, carbon tetrachloride, a di- or trihaloalkene or a haloacetic acid. Particularly preferred among the di- or trihaloalkylacetates are trichloroalkyl acetates, especially, trichloromethyl acetate. Particularly preferred among the di- or trihaloalkenes is trichloroethylene. Particularly preferred among the haloacetic acids is trichloroacetic acid.

In accordance with another aspect of the present invention, there is provided a method of etching copper comprising the step of contacting the copper to be etched with an nonaqueous solution comprising dimethyl sulfoxide and a halocarbon compound.

Further objects, features and advantages will be apparent from the following description of presently preferred embodiments of the invention.

DETAILED DESCRIPTION OF PREFERRED EMBODIMENTS

The etching solution of the present invention is nonaqueous. It comprises dimethyl sulfoxide (DMSO) and a halocarbon compound. The ratio of components present in the solution varies according to the selection of the etch time. Particularly, as the amount of halocarbon compound decreases, the etch rate also decreases. Dimethyl sulfoxide (DMSO) in the mixtures serves as the major copper complexing compound. A wide variety of halocarbon compounds are found to be effective in the present invention. For example, mono- or multi-haloalkylacetates, haloalkanes, haloalkenes, and halocarboxylic acids provide advantageous etching properties. Particularly preferred are trichloroalkyl acetates, carbon tetrachloride, trichloroethylene, and trichloroacetic acid.

The solutions are prepared simply by mixing together the DMSO and the halocarbon compound at room temperature. When using the solution to etch copper, conventional operating conditions for copper etching are suitable.

The following non-limiting examples are provided to further illustrate the invention. It is understood that the ratios, rather than the amounts, of the components used is what is responsible for the results obtained. It is further understood that the amount of solution used should not affect the etching time.

EXAMPLE 1

A copper etch solution was prepared by mixing together the following components at room temperature.

16 cc dimethyl sulfoxide (DMSO)

4 cc trichloroethylacetate

The solution was used to etch a silicon wafer having a sputtered copper blanket layer applied thereto of a thickness of about 2500 angstroms. The wafer also included copper lines overcoated with nickel. The wafer was dipped into the etching solution. The blanket copper was etched from the wafer within about 45 seconds. The nickel overcoat and underlying copper lines were unaffected.

EXAMPLE 2

Other etching solutions were prepared and tested in the manner described in Example 1. The ratio of DMSO and trichloroethylacetate were varied. The following table depicts the results.

TABLE 1

| DMSO (cc) | Trichloroethyl acetate (cc) | Etch time (sec.) |
|---|---|---|
| 12 | 8 | 35 |
| 8 | 12 | 30 |
| 4 | 16 | 35 |

As in Example 1, the nickel overcoat and the underlying copper lines were unaffected. The results evidence that the etching solution combines advantageous etching rates and selectivity.

EXAMPLE 3

Example 1 was repeated; however, in this example, the weight of the copper samples was varied. The copper samples were placed in 20 cc of etching solution. The results are set forth in Table 2.

TABLE 2

| Cu Wt. (grams) | Etch time (sec.) |
|---|---|
| .0032 | 36 |
| .0070 | 36 |
| .0125 | 26 |
| .0162 | 26 |

These results illustrate that the present solution does not exhibit a loading effect.

EXAMPLE 4

A DMSO:trichloroethyl acetate etching solution in a 4:1 ratio was prepared. The purpose of the example was to determine the etch rate of the solution on a 5 micron copper sample. Table 3 presents the results for a 20 cc solution. Table 4 does likewise for a 40 cc solution. The test was run in four (4) separate samples of identical solution to confirm uniformity.

TABLE 3

| Run | Etch time (min, sec.) |
|---|---|
| 1 | 13 min, 5 sec. |
| 2 | 13 min, 50 sec. |
| 3 | 12 min, 40 sec. |
| 4 | 12 min, 40 sec. |

TABLE 4

| Run | Etch time (min, sec) |
|---|---|
| 1 | 14 min, 21 sec. |
| 2 | 13 min, 20 sec. |
| 3 | 16 min, 0 sec. |
| 4 | 14 min, 0 sec. |

EXAMPLE 5

A copper etch solution having the following formulation was prepared by mixing the components together at room temperature.

16 cc dimethyl sulfoxide
4 cc trichloromethylacetate

As in Example 1, the solution was used to etch a silicon wafer having a sputtered copper blanket layer applied thereto of a thickness of 2500 angstroms. The wafer also included copper lines overcoated with nickel.

The wafer was dipped into the solution The blanket copper was etched from the wafer in about 25–30 sec. The nickel overcoat and underlying copper lines were unaffected.

EXAMPLE 6

The test of Example 5 was repeated; however, the concentration of DMSO and trichloromethylacetate was varied. The results are set out in Table 5.

TABLE 5

| DMSO (cc) | Trichloroethyl acetate (cc) | Etch time (sec.) |
|---|---|---|
| 19 | 1 | 47 |
| 12 | 1 | 25–30 |
| 8 | 12 | 17 |
| 4 | 16 | 25 |

The results show that trichloromethylacetate produced a somewhat faster etching rate than did trichloroethylacetate. The wide range in component rates, i.e, 19:1 to 1:4 (DMSO:halocarbon) evidences the versatility of the present solution.

EXAMPLE 7

A copper etch solution having the following formulation was prepared by mixing the components together at room temperature.

40 cc dimethyl sulfoxide
10 cc carbon tetrachloride

As in Example 1, the solution was used to etch a silicon wafer having a sputtered blanket copper layer applied thereto of a thickness of about 2500 angstroms. The wafer also included copper lines overcoated with nickel. The wafer was dipped into the solution. The blanket copper was etched from the wafer in about 39 minutes. The nickel overcoat and the underlying copper lines were unaffected.

EXAMPLE 8

The test of Example 7 was repeated; however, the concentration of DMSO and carbon tetrachloride was varied. The results are set out in Table 6.

TABLE 6

| DMSO (cc) | Carbon tetrachloride (cc) | Etch time (min.) |
|---|---|---|
| 30 | 20 | 39 |
| 20 | 30 | 34 |
| 10 | 40 | 19 |

EXAMPLE 9

In order to determine the effect of an additive to the solution, HCl was added to the solution and the etching rate measured. The formulation of the solution was as follows:

40 cc dimethyl sulfoxide
10 cc trichloroethylene
1 cc HCl

As in Example 1, the solution was used to etch a silicon wafer having a sputtered blanket copper layer applied thereto of a thickness of about 2500 angstroms. The wafer also included copper lines overcoated with nickel. The wafer was dipped into the solution. The blanket copper was etched from the wafer in about five (5) hours. The nickel overcoat and underlying copper wires were unaffected.

The results show that the addition of HCl retards etching.

EXAMPLE 10

The test of Example 9 was repeated; however, the concentration of DMSO and trichloroethylene was varied. The HCl content remained constant. The results are set out in Table 7.

TABLE 7

| DMSO (cc) | trichloroethlene (cc) | Etch time (hr:min) |
|---|---|---|
| 30 | 20 | 3:24 |
| 20 | 30 | 4:03 |
| 10 | 40 | Incomplete |

These results confirm the detrimental effect of HCl on the etching solution previously noted in Example 9.

EXAMPLE 11

As another attempt to test the loading effect of the present copper etching solution, multiple copper samples were placed in a 4 parts DMSO:1 part trichloroethylacetate solution bath. The solution was prepared and the test conducted as in the previous examples. The copper thickness was 5 microns, rather than the previous 2500 angstroms thickness. The results are shown below.

TABLE 8

| Cu Pieces | Cu conc. in solution (M) | Etch time (min:sec) |
|---|---|---|
| ½ | .028 | 10 min: 30 sec. |
| 1 | .051 | 8 min: 50 sec. |
| 2 | .106 | 20 min: 30 sec. |
| 4 | .211 | 17 min: 0 sec. |

The results show a proportional loading effect and, thus, uniformity in solution effectiveness for various scale copper workpieces.

From these examples it can be seen that a nonaqueous solution of DMSO and a halocarbon compound provides advantageous copper etching capabilities, particularly acceptable etching rates and advantageous selectivity capability.

The present invention, therefore, is well adapted to carry out the objects and attain the ends and advantages mentioned. Preferred embodiments of the invention have been described for the purpose of disclosure, and numerous changes in the selection and the ratio of components in the composition will be readily apparent to those skilled in the art. The modifications are encompassed within the spirit of the present invention and the scope of the appended claims.

What is claimed is:

1. A nonaqueous copper etching solution, comprising:

dimethyl sulfoxide; and a halocarbon compound.

2. A nonaqueous copper etching solution as claimed in claim 1, wherein said halocarbon compound is a mono- or multi- haloalkylacetate, a haloalkane, a haloalkene, or a halocarboxylic acid.

3. A nonaqueous copper etching solution as claimed in claim 1, wherein said halocarbon compound is a dihaloalkylacetate, a trihaloalkylacetate, carbon tetrachloride, dihaloalkene, trihaloalkene, a dihaloacetic acid or a trihaloacetic acid.

4. A nonaqueous copper etching solution as claimed in claim 3, wherein said halocarbon compound is a trichloroalkly acetate.

5. A nonaqueous copper etching solution as claimed in claim 4, wherein said trichloroalkyl acetate is trichloromethyl acetate.

6. A nonaqueous copper etching solution as claimed in claim 4, wherein said trichloroalkyl acetate is trichloroethyl acetate.

7. A nonaqueous copper etching solution as claimed in claim 1, wherein said halocarbon compound is carbon tetrachloride.

8. A nonaqueous copper etching solution as claimed in claim 1, wherein said halocarbon compound is trichloroethylene.

9. A nonaqueous copper etching solution as claimed in claim 1, wherein said halocarbon compound is trichloroacetic acid.

10. A method of etching copper comprising the step of contacting the copper to be etched with an nonaqueous solution comprising dimethyl sulfoxide and a halocarbon compound.

* * * * *